US008679710B2

(12) United States Patent
Kuboshima et al.

(10) Patent No.: US 8,679,710 B2
(45) Date of Patent: Mar. 25, 2014

(54) ELECTROPHOTOGRAPHIC PHOTORECEPTOR AND IMAGE FORMING APPARATUS

(75) Inventors: Daisuke Kuboshima, Osaka (JP); Eiichi Miyamoto, Osaka (JP); Kazunari Hamasaki, Osaka (JP); Norio Nakai, Osaka (JP); Yoshio Inagaki, Osaka (JP); Hideki Okada, Osaka (JP); Tetsuya Ichiguchi, Osaka (JP); Keiji Maruo, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 787 days.

(21) Appl. No.: 11/317,852

(22) Filed: Dec. 22, 2005

(65) Prior Publication Data

US 2006/0141377 A1 Jun. 29, 2006

(30) Foreign Application Priority Data

Dec. 24, 2004 (JP) ..... 2004-373635

(51) Int. Cl.
*G03G 5/047* (2006.01)
*G03G 5/06* (2006.01)

(52) U.S. Cl.
CPC ..... *G03G 5/0614* (2013.01)
USPC ..... 430/58.85; 430/56; 430/70; 430/73

(58) Field of Classification Search
USPC ..... 430/56, 70, 73, 58.85
See application file for complete search history.

(56) References Cited

U.S. PATENT DOCUMENTS

| | | | | |
|---|---|---|---|---|
| 5,206,103 | A * | 4/1993 | Stolka et al. | 430/58.2 |
| 5,910,610 | A * | 6/1999 | Kobayashi et al. | 564/315 |
| 6,258,499 | B1 * | 7/2001 | Itami | 430/66 |
| 6,573,017 | B2 | 6/2003 | Azuma et al. | |
| 2002/0119385 | A1 * | 8/2002 | Azuma et al. | 430/96 |
| 2004/0224245 | A1 * | 11/2004 | Shigezaki et al. | 430/66 |
| 2005/0238975 | A1 * | 10/2005 | Fujiki et al. | 430/66 |
| 2006/0024596 | A1 * | 2/2006 | Azuma et al. | 430/73 |

FOREIGN PATENT DOCUMENTS

| | | | |
|---|---|---|---|
| JP | 06075394 | * | 3/1994 |
| JP | 2000-194242 | | 7/2000 |
| JP | 2005107321 | * | 4/2005 |

* cited by examiner

*Primary Examiner* — Peter Vajda
(74) *Attorney, Agent, or Firm* — DLA Piper LLP (US)

(57) ABSTRACT

The present invention provides an electrophotographic photoreceptor comprising a photosensitive layer that contains at least a charge generating agent, a hole transport agent and a prede mulas (A) and (B). The electrophotographic photoreceptor prevents image defect termined additive. The hole transport agent satisfies the following for from occurring and can meet the demand for higher speed image forming apparatuses, by reducing the adhesion of paper dust and preventing the occurrence of cracks.

$$\frac{\mu}{M} < 1.2\times10^{-8} \quad \text{(A)}$$

$$\mu > 5.0\times10^{-6} \quad \text{(B)}$$

$\mu$: Hole mobility ($cm^2 \cdot V^{-1} \cdot second^{-1}$) of hole transport agent in the electric field intensity of $3\times10^5 (V/cm)$ $M$: Molecular weight of hole transport agent

1 Claim, 2 Drawing Sheets

ELECTROPHOTOGRAPHIC PHOTORECEPTOR AND IMAGE FORMING APPARATUS

Priority is claimed to Japanese Patent Application No. 2004-373635 filed on Dec. 24, 2004, the disclosure of which is incorporated by reference in its entirety.

BACKGROUND OF THE INVENTION

1. Field of the Invention

The present invention relates to an electrophotographic photoreceptor that can prevent paper dust from adhering to a photoreceptor and black spots and black lines from appearing by optimizing the composition of a photoreceptor, and an image forming apparatus using the same.

2. Description of Related Art

In an image forming apparatus, transfer media (for example, paper) and a developer are used. The paper and the developer contain powdery substances such as talc, silicon compound and titanium compound which cause filming on the photoreceptor drum of an image forming apparatus. In addition, when such contaminants as oil component or bleed component that comes from the constituent materials of various members such as development or transfer mechanisms as a result of their contact in incorporating a photoreceptor into a unit adhere to the photoreceptor surface, a photosensitive layer is contaminated and cracks occur on the photosensitive layer. The above filming and cracks occurring on a photosensitive layer, in many cases, result in image defect. Specific examples of image defect include black spots, black lines or fog which appear on an image when toner is developed in other section (blank space section) than the intended section on a drum.

Recently, image forming apparatuses have been required to perform higher speed process. Such higher speed process significantly burdens paper on a feeding path. As a result, more paper dust comes from paper and adheres to a photoreceptor.

Moreover, in the light of having compact size and being unable to conduct blade cleaning while using toner that has almost perfectly round shape, recent image forming apparatuses often employ simultaneous development and cleaning system (cleaner-less method). With such cleaner-less method, it is impossible to remove paper dust and the like. Japanese Unexamined Patent Publication No. 2000-194242 proposes a cleaner-less image forming apparatus with a device to remove paper dust.

As a measure against image defect, generally, such substances adhering to a photoreceptor as paper dust are removed in cleaning process, but the problem is that this is not enough. For example, the use of a fur brush (rotating brush), a roller or the like in cleaning process makes it possible to efficiently collect paper dust. However, such cleaning process is not preferable in order to make an image forming apparatus more compact. Even if simple cleaning process with a fixed brush etc. is employed so as to make an image forming apparatus more compact, the problem still arises that it is difficult to completely collect paper dust. Furthermore, the simple cleaning process only removes adhering paper dust and never reduces the adhesion of paper dust itself.

SUMMARY OF THE INVENTION

The present invention provides an electrophotographic photoreceptor and an image forming apparatus using the same. The electrophotographic photoreceptor can meet the demand for higher speed image forming apparatuses while preventing image defect from occurring through the method to optimize the composition of a photoreceptor and prevent paper dust from adhering to the photoreceptor, not through the method to remove such substances adhering to a photoreceptor as paper dust in cleaning process.

The present inventors have been devoted to doing research and found that the use of a hole transport agent that has large conjugated planar structure in a molecule makes it easy for paper dust to adhere to a photosensitive layer and for black spots and black lines to occur. Moreover, deriving the threshold value of occurrence or nonoccurrence of black spots from the relation between hole mobility and molecular weight in a hole transport agent, the present inventors have found that by optimizing the composition of a photoreceptor with the use of the threshold value, it is possible to prevent paper dust and the like from adhering to the photoreceptor. In addition, contaminants adhering to the surface of a photoreceptor allow monomer components in a photosensitive layer, especially, a charge transport agent to leak out of the photosensitive layer, which easily causes cracks. The present inventors have found that the addition of a plasticizer as additive to a photosensitive layer makes it possible to prevent cracks, black spots and black lines from occurring. The electrophotographic photoreceptor of the present invention has the following characteristics.

(1) The electrophotographic photoreceptor comprises an electroconductive substrate, and a photosensitive layer disposed on the electroconductive substrate and containing at least a charge generating agent and a hole transport agent. The hole transport agent satisfies the following formulas (A) and (B).

$$\frac{\mu}{M} < 1.2\times10^{-8} \quad \text{(A)}$$

$$\mu > 5.0\times10^{-6} \quad \text{(B)}$$

$\mu$: Hole mobility ($cm^2 \cdot V^{-1} \cdot second^{-1}$) of hole transport agent in the electric field intensity of $3\times10^5 (V/cm)$ $M$: Molecular weight of hole transport agent (2) The hole transport agent may have either a site represented by the following (a) or a site represented by the following (b) in a molecule, provided that the said site may have a substituent.

(a)

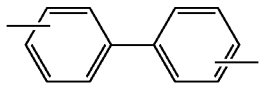

(b)

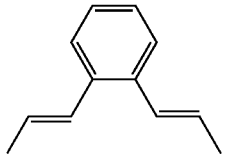

(3) The hole transport agent is represented by any of the following formulas (I) to (III), (I)

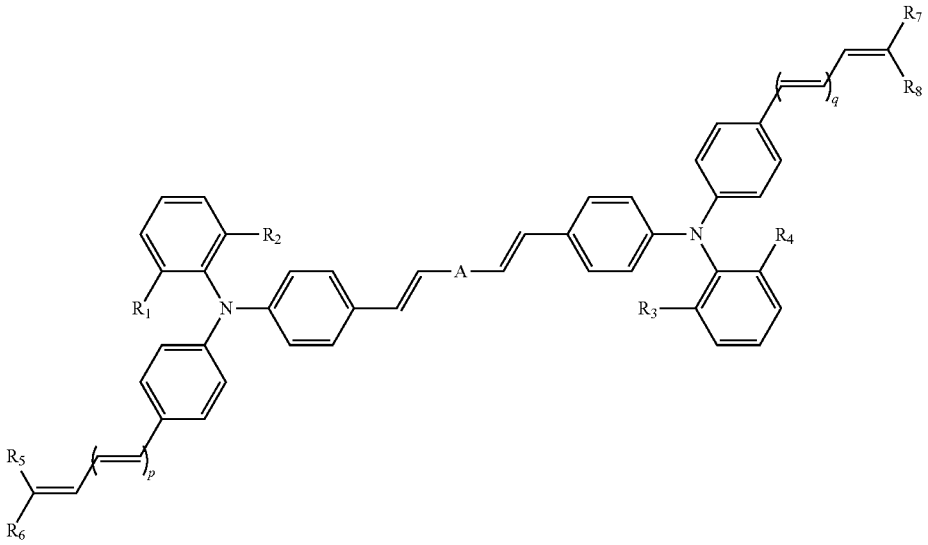

(II)

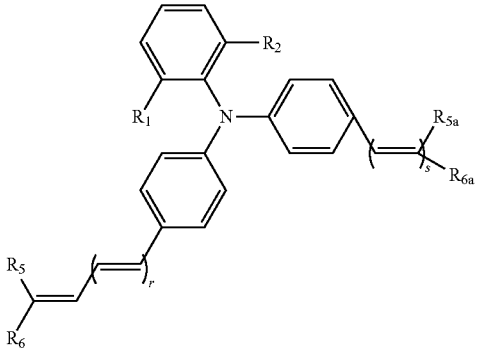

(III)

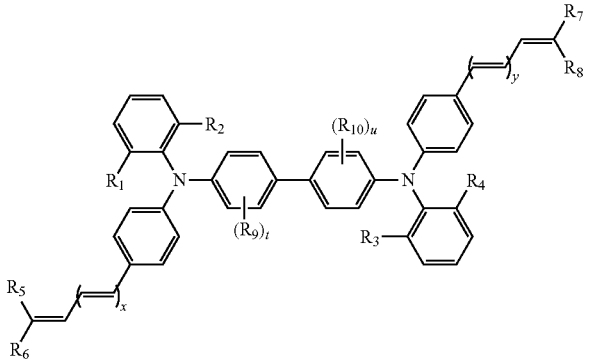

wherein $R_1$ to $R_4$ are the same or a different group and represent a hydrogen atom or an alkyl group having a carbon number of 1 to 6, $R_5$ to $R_{10}$, $R_{5a}$ and $R_{6a}$ are the same or a different group and represent a hydrogen atom, an alkyl group or an aryl group, "A" represents an arylene group or a biphenyl residue wherein two aromatic rings respectively form a monovalent group, the letters p, q, r, s, x and y represent an integer of 0 to 2, and the letters t and u represent an integer of 1 to 4.

(4) The photosensitive layer may contain, as additive, at least one selected from the following compounds (IV) to (VII), (IV)

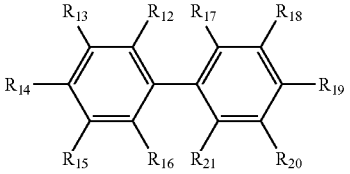

-continued (V)

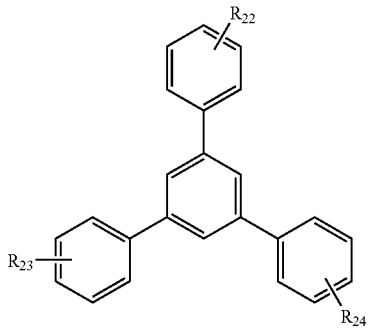

(VI)

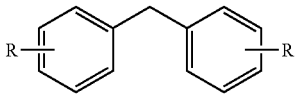

-continued (VII)

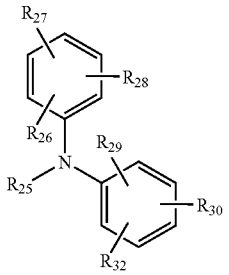

wherein $R_{12}$ to $R_{31}$ and R are the same or a different group and represent a hydrogen atom, an alkyl group that may have a substituent, an aryl group that may have a substituent, an aralkyl group that may have a substituent, a cycloalkyl group that may have a substituent, a halogen atom, an alkoxy group, a hydroxyl group, a cyano group, a nitro group, an amino group or a halogenated alkyl group.

(5) To the total amount of components constituting the photosensitive layer, 1.5 to 15.0% by weight of at least one selected from the above compounds (IV) to (VII) may be contained.

(6) The compound (IV) may have at least one structure selected from the following formulas (VIII)-1 to (VIII)-4.

(VIII)-1

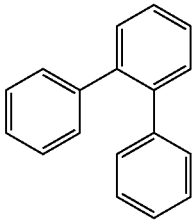

(VIII)-2

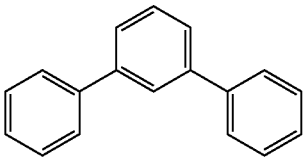

(VIII)-3

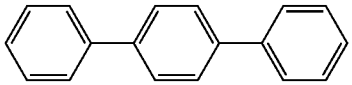

(VIII)-4

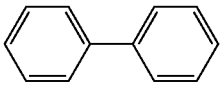

(7) The above compound (VII) may have at least one structure selected from the following formulas (IX)-1 to (IX)-8.

(IX)-1

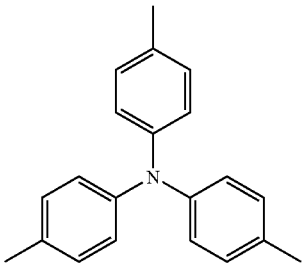

(IX)-2

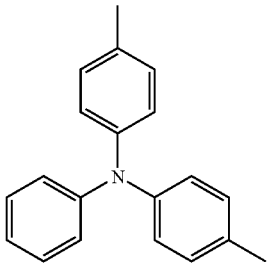

(IX)-3

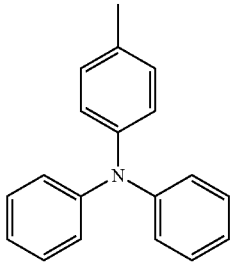

(IX)-4

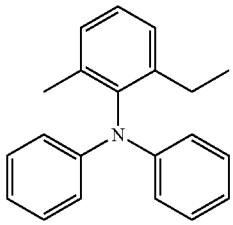

(IX)-5

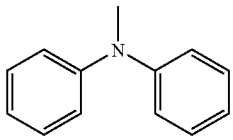

(IX)-6

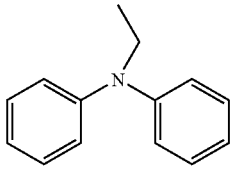

(IX)-7

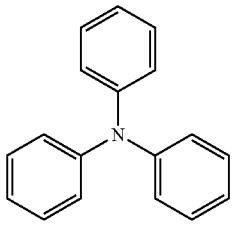

-continued (IX)-8

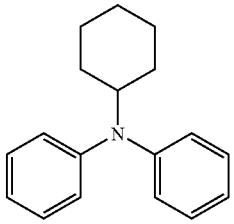

(8) The electrophotographic photoreceptor of the present invention may be a single-layer electrophotographic photoreceptor which contains the charge generating agent and the hole transport agent in the same layer.

(9) The electrophotographic photoreceptor of the present invention may be applied to an image forming apparatus employing simultaneous development and cleaning system.

(10) An image forming apparatus employing simultaneous development and cleaning system preferably comprises the above electrophotographic photoreceptor, and at least a charging device, an exposing device, a developing device and a transfer device that are disposed along the moving direction of the electrophotographic photoreceptor.

As apparent from many experimental results, according to the above (1) to (3) and (8) to (10), the electrophotographic photoreceptor employing a hole transport agent that satisfies the formula (A) reduces adhering paper dust and black spots. Also, since the employed hole transport agent satisfies the formula (B) as well, that is, has not less than a certain level of hole mobility, it is possible to meet the demand for higher speed image forming apparatuses. Consequently, it becomes possible to provide an electrophotographic photoreceptor that can meet the demand for higher speed image forming apparatuses while preventing image defect from occurring through the method to reduce the adhesion of paper dust, not through the method to remove paper dust in cleaning process.

According to the above (4) to (7), a plasticizer as additive is added to a photosensitive layer, thereby reducing monomer components that leak out of the photosensitive layer. This makes it possible to prevent cracks from occurring and reduce the amount of monomer components leaking to contamination resistant substances.

According to the above (8) to (10), it is possible to obtain an electrophotographic photoreceptor that can meet the demand for higher speed apparatuses while reducing the adhesion of paper dust to the photoreceptor surface and being able to keep images high-quality even with adhering contaminants. Consequently, it becomes possible to obtain a high speed image forming apparatus that can be made compact through minimizing cleaning process.

DETAILED DESCRIPTION OF PREFERRED EMBODIMENTS

<Mechanism of Black Spots Occurring>

Figure 1:
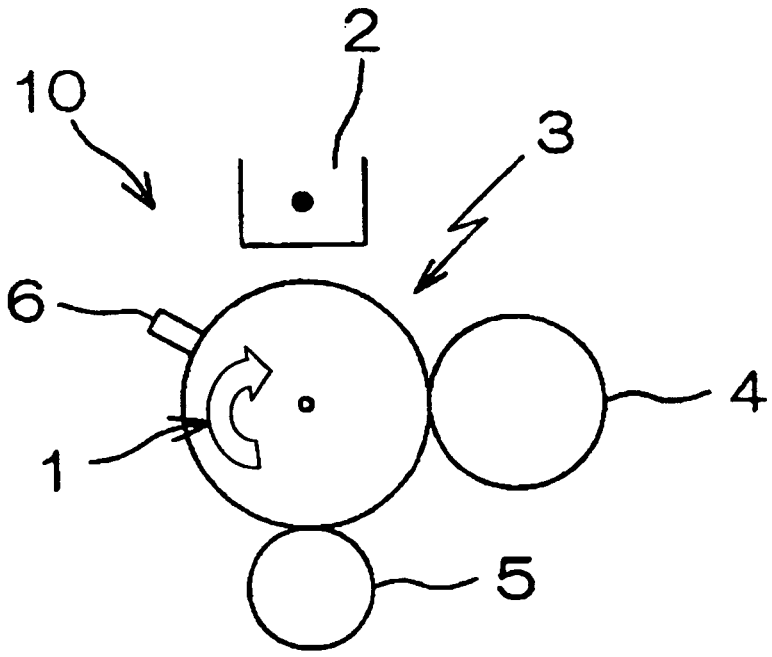
FIG. 1 is a schematic illustration showing one embodiment of the image forming apparatus of the present invention.

The electrophotographic photoreceptor of the present invention can prevent paper dust from adhering to a photoreceptor and also cracks caused by adhering contaminants, black spots and black lines from occurring by optimizing its composition. First, the mechanism of black spots or the like occurring will be described.

One of the reasons that black spots appear on an image is that toner is developed in other section (blank space section) than the intended one on a photoreceptor. The possible reason of toner developed on a photoreceptor in a blank space section as above is that in the blank space section, toner should be carried on a developing roller by the electric field intensity between the photoreceptor and the developing roller but it has been transferred from the developing roller to the photoreceptor.

More black spots are observed under highly humid conditions. Therefore, it is considered that under highly humid conditions, in particular, adhesive force between a photoreceptor and toner increases and the adhesive force partially exceeds the force of carrying toner on a developing roller, thereby causing black spots and black lines.

According to the analysis of a phenomenon happening in toner and a photoreceptor under highly humid conditions, it is considered that as for toner, as humidity level goes up, the charge quantity of toner goes down, making it difficult for toner to act normally.

It is considered that when filming occurs due to paper dust, a photoreceptor is apt to be influenced by humidity and the charged electric potential is lowered, making it impossible to obtain desired electric field intensity in the blank space section. Moreover, in case of the filming of paper dust on a photoreceptor, moisture absorbed in paper dust increases the adhesive force of toner to the photoreceptor, making it easy for toner to adhere to the photoreceptor. This phenomenon is remarkable, when polarity is negative in transfer process and a transfer member (for instance, transfer roller) is disposed in contact with a photoreceptor. That is, when negative electric field is impressed in transfer process, paper dust which is apt to be negatively charged easily adheres to a photoreceptor through transfer process. If paper dust is not collected by a cleaning device, part of it sticks to a photoreceptor (filming), facilitating a partial decrease in electric potential of the photoreceptor and an increase in water bridging force. In other words, in positively charged reversal development method, it is considered that since polarity is negative in transfer process, filming and black spots easily occur.

When development method is contact-type or when the distance between a developing roller and a photoreceptor is extremely small, toner is physically apt to adhere to a photoreceptor, thereby causing black spots easily. Furthermore, a higher speed image forming apparatus puts larger burden on paper and facilitates the occurrence of paper dust, causing more black spots.

Consequently, one of the reasons of black spots occurring seems to be the adhesion of paper dust to a photoreceptor. The elements which can influence the adhesion of paper dust to a photoreceptor are summed up as follows.

(Element 1) Paper dust which is apt to be negatively charged while transfer polarity is negative is attracted to the direction of a positively charged photoreceptor by electrostatic force.

(Element 2) In order to make an image forming apparatus more compact and use toner having almost perfectly round shape, an image forming apparatus employing simultaneous development and cleaning system (cleaner-less method) is adopted. If cleaning process to collect paper dust is provided, an image forming apparatus cannot be made compact, and therefore it is not desirable to provide it. Even with cleaning process provided, smaller size is required, making it difficult to achieve enough cleaning effect.

(Element 3) When there are a few scraping members to a photoreceptor, it is hard to remove adhering paper dust and easy for paper dust to stick (filming). Especially, an image forming apparatus employing simultaneous development and cleaning system (cleaner-less method) has a few scraping members, making it easy for paper dust to stick (filming).

(Element 4) Higher speed image forming apparatuses put larger burden on paper in a feeding path, and paper dust easily occurs.

Another reason of black spots appearing on an image is cracks on the photoreceptor surface. This is possibly because there is a leak in a crack occurring portion on the photoreceptor surface, and toner that should be carried on a developing roller by the electric field intensity between a photoreceptor and developing bias in a blank space section cannot keep charged and transfers from a developing roller to a drum.

When contaminants having oil component adhere to the photoreceptor surface, monomer components easily leak out of a photosensitive layer. It is conceivable that leaking monomer components allow voids to be produced in the binder resin of a photosensitive layer, and partial force acts on and breaks down the portion where the voids are produced, thereby causing cracks.

The present inventors have reviewed the elements that influence the adhesion of paper dust to a photoreceptor and the mechanism of cracks occurring and have concluded that it is necessary to reduce the adhesion of paper dust to a photoreceptor itself and prevent cracks from occurring, not to remove paper dust and contaminants in cleaning process. In short, they have found that by optimizing the composition of a photoreceptor, it is possible to prevent paper dust from adhering to a photoreceptor and cracks from occurring. Specifically, the composition of a photoreceptor is optimized with the use of a certain hole transport agent and an additive.

<Hole Transport Agent>

To specify a hole transport agent for optimizing the composition of a photoreceptor, verification by many experiments has been required. As a result, it has become apparent that a hole transport agent having larger conjugated planar structure in a molecule makes it easy for paper dust to adhere and for black spots and black lines to occur. The threshold value of black spots occurring have been derived from the relation between hole mobility and molecular weight in a hole transport agent. The above formula (A) represents the result.

The hole transport agent used in the present invention satisfies the formula (A). This means that in the hole transport agent, even if molecular weight turns large, hole mobility does not exceed a certain value. In other words, the hole transport agent that satisfies this formula has no large conjugated planar part in a molecule and it is a compound having twist structure in a molecule.

A hole transport agent having excessively large molecular weight has difficulties in dissolving in a solvent for preparing a photoreceptor applying solution. Therefore, it is preferable that $\mu/M$ is not less than $0.25\times10^{-8}$.

In addition, the hole transport agent used in the present invention satisfies the formula (B) as well. That is, the use of a hole transport agent having not less than a certain level of hole mobility makes it possible to meet the demand for higher speed image forming apparatuses.

The hole transport agent used in the present invention preferably has either the above (a) or (b) sites. Examples of the above (a) site include a site having a biphenyl skeleton, a site having a dimethyl-biphenyl skeleton ant the like, but a binding site is not especially limited. The groups of the (a) and (b) can have a substituent such as an alkyl group and an aryl group. Examples of the substituent include alkyl groups having a carbon number of 1 to 6 such as a methyl group, an ethyl group, a n-propyl group, an isopropyl group, a n-butyl group, an isobutyl group, a s-butyl group, a t-butyl group, a pentyl group, an isopentyl group, a neopentyl group and a hexyl group, phenyl groups, tolyl groups and xylyl groups.

The hole transport agent used in the present invention is preferably represented by any of the above formulas (I) to (III). Examples of the alkyl group having a carbon number of 1 to 6 in $R_1$ to $R_4$ include a methyl group, an ethyl group, a n-propyl group, an isopropyl group, a n-butyl group, an isobutyl group, a s-butyl group, a t-butyl group, a pentyl group, an isopentyl group, a neopentyl group and a hexyl group. Examples of the alkyl group in $R_5$ to $R_{10}$ include alkyl groups having a carbon number of 1 to 6 such as a methyl group, an ethyl group, a n-propyl group, an isopropyl group, a n-butyl group, an isobutyl group, a s-butyl group, a t-butyl group, a pentyl group, an isopentyl group, a neopentyl group and a hexyl group. Examples of the aryl group in $R_5$ to $R_{10}$ include aryl groups having a carbon number of 6 to 20 such as a phenyl group, a tolyl group and a xylyl group. The above aryl group can have a substituent, and examples of the substituent include an alkyl group having a carbon number of 1 to 6 and an alkoxy group having a carbon number of 1 to 6.

Preferably, at least one of $R_1$ to $R_4$ is an alkyl group having a carbon number of 1 to 6. An alkyl group having a carbon number of 1 to 6 at a certain site of substitution makes it possible to effectively have twist structure in the molecule of a hole transport agent, improve solubility in binder resin and increase the mobility of a hole transport agent.

Examples of the arylene group in "A" of the formula (I) include an o-phenylene group, an m-phenylene group, a p-phenylene group and a naphthylene group, and a binding site is not especially limited. Examples of the biphenyl residue wherein two aromatic rings respectively form a monovalent group in "A" include a group having a biphenyl skeleton and a group having a dimethyl-biphenyl skeleton, and a binding site is not especially limited.

The hole transport agent having the above (a) and (b) groups and the hole transport agent represented by the formulas (I) to (III) are exemplified by the following HTM-1 to HTM-7.

HTM-1
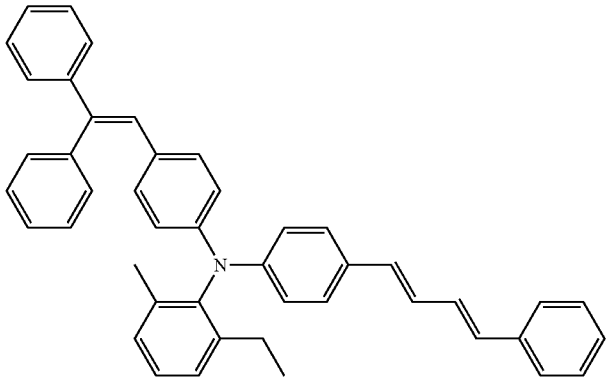
HTM-2
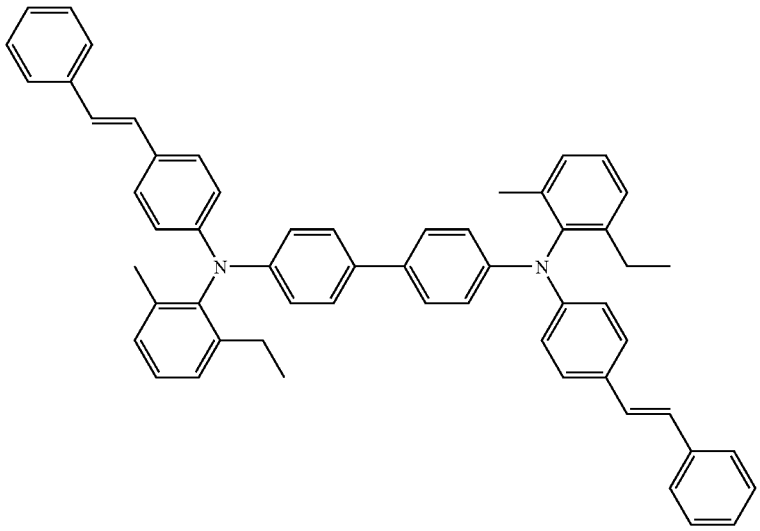
HTM-3
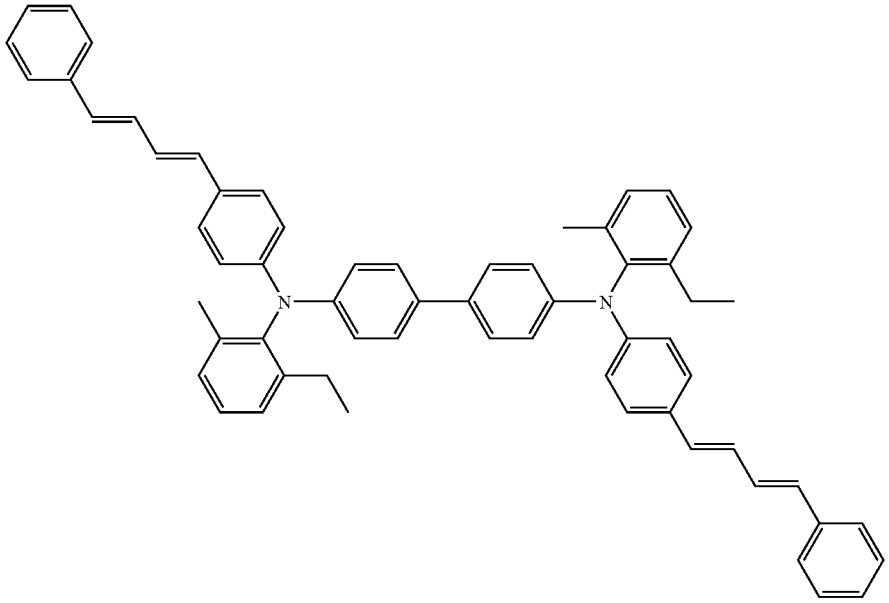

-continued
HTM-4
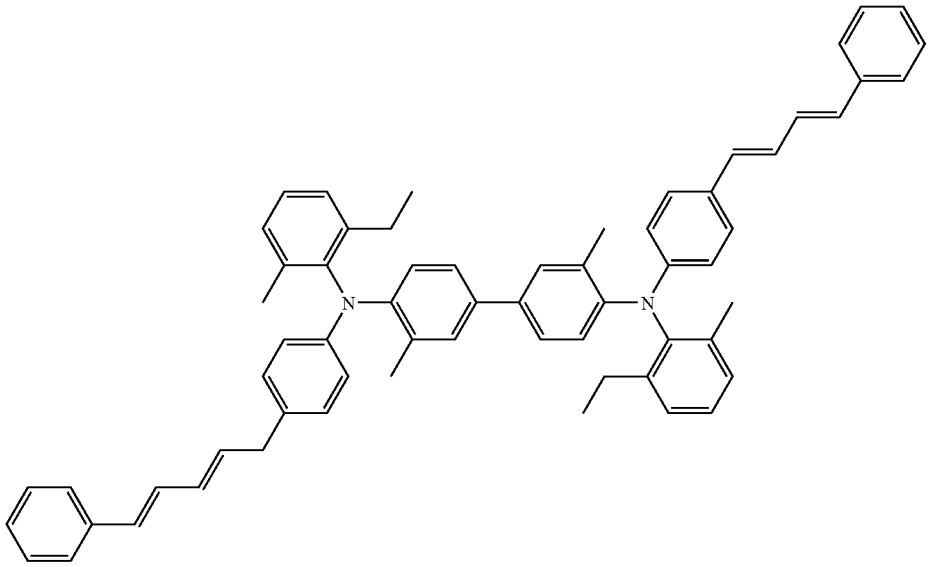
HTM-5
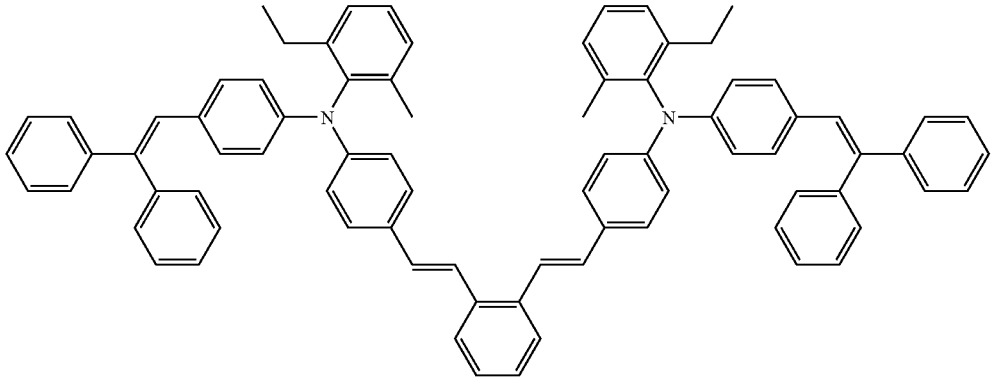
HTM-6
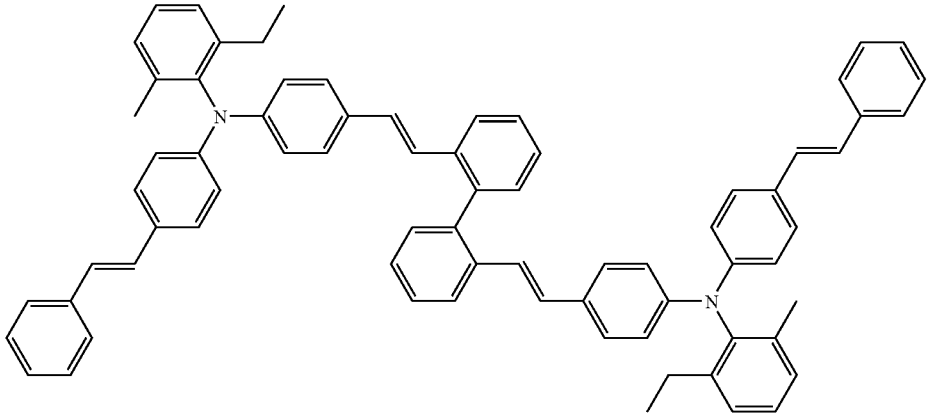

-continued

HTM-7

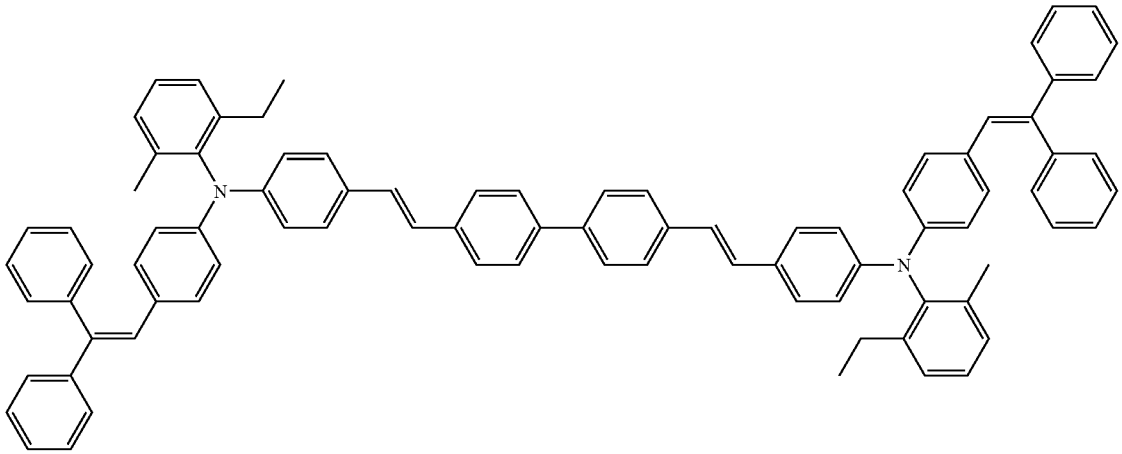

In the present invention, one or more kinds of hole transport agent satisfying the above formulas (A) and (B) can be used. If necessary, the hole transport agent in the present invention can be used together with another hole transport agent.

<Charge Generating Agent>

Next, the charge generating agent used to obtain the electrophotographic photoreceptor of the present invention will be described. Examples of the charge generating agent include organic photo conductors such as phthalocyanine pigment (e.g. metal-free phthalocyanine, hydroxygallium phthalocyanine, chlorogallium phthalocyanine, α-titanyl phthalocyanine, Y-titanyl phthalocyanine and V-hydroxygallium phthalocyanine), perylene pigment, bisazo pigment, dithioketopyrrolopyrrole pigment, metal-free naphthalocyanine pigment, metal naphthalocyanine pigment, squaline pigment, trisazo pigment, indigo pigment, azulenium pigment, cyanine pigment, pyrylium pigment, anthanthrone pigment, triphenylmethane pigment, threne pigment, toluidine pigment, pyrrazoline pigment and quinacridone pigment, and inorganic photoconducting materials such as selenium, selenium-tellurium, selenium-arsenic, cadmium sulfide and amorphous silicon. These charge generating agents can be used alone or with a combination of two or more kinds.

Particularly, in the present invention, as a charge generating agent, at least one selected from phthalocyanine pigments, especially metal-free phthalocyanine (e.g. X-type metal-free phthalocyanine), titanyl phthalocyanine, hydroxygallium phthalocyanine and chlorogallium phthalocyanine is preferably used in terms of electric property of a photoreceptor when exposure light source is red light or infrared light of 650 nm or more such as LED or laser.

<Electron Transfer Agent>

Examples of the electron transfer agent include compounds having electron acceptability such as diphenoquinone derivative, benzoquinone derivative, naphthoquinone derivative, anthraquinone derivative, malononitrile derivative, thiopyran derivative, thioxanthone derivative (2,4,8-trinitrothioxanthone etc.), fluorenone derivative (3,4,5,7-tetranitro-9-fluorenone derivative etc.), anthracene derivative, acridine derivative, dinitrobenzene, dinitroanthracene, dinitroacridine, succinic anhydride derivative, maleic anhydride derivative and dibromomaleic anhydride derivative.

<Additive>

The additive used to obtain the electrophotographic photoreceptor of the present invention is preferably represented by any of the above formulas (IV) to (VII). Examples of the alkyl group in R and $R_{12}$ to $R_{31}$ include alkyl groups having a carbon number of 1 to 6 such as a methyl group, an ethyl group, a n-propyl group, an isopropyl group, a n-butyl group, an isobutyl group, a s-butyl group, a t-butyl group, a pentyl group, an isopentyl group, a neopentyl group and a hexyl group. Examples of the aryl group in $R_{12}$ to $R_{31}$ include aryl groups having a carbon number of 6 to 20 such as a phenyl group, a tolyl group, a xylyl group, a biphenylyl group and a naphthyl group. Examples of the aralkyl group in $R_{12}$ to $R_{31}$ include aralkyl groups having a carbon number of 6 to 20 such as benzyl, α-methylbenzyl, phenethyl, styryl, cinnamyl, 3-phenylpropyl, 4-phenylbutyl, 5-phenylpentyl and 6-phenylhexyl. Examples of the cycloalkyl group in $R_{12}$ to $R_{31}$ include cycloalkyl groups having a carbon number of 3 to 10 such as cyclopropyl, cyclobutyl, cyclopentyl, cyclohexyl, cycloheptyl and cyclooctyl. Examples of the alkoxy group in $R_{12}$ to $R_{31}$ include alkoxy groups having a carbon number of 1 to 6 such as methoxy, ethoxy, propoxy, isopropoxy, butoxy, t-butoxy, pentyloxy or hexyloxy. Examples of the halogenated alkyl group in $R_{12}$ to $R_{31}$ include alkyl groups having a carbon number of 1 to 6 and substituted by 1 to 3 halogen atoms, such as monochloromethyl, monobromomethyl, monoiodomethyl, monofluoromethyl, dichloromethyl, dibromomethyl, diiodomethyl, difluoromethyl, trichloromehyl, tribromomethyl, triiodomethyl, trifluoromethyl, monochloroethyl, monobromoethyl, monoiodoethyl, monofluoroethyl, dibromobutyl, diiodobutyl, difluorobutyl, chlorohexyl, bromohexyl, iodohexyl or fluorohexyl.

As for the additive used in the present invention, preferably, a compound represented by the above formula (IV) has any one or more structures of the above formulas (VIII)-1 to (VIII)-4.

Furthermore, as for the additive used in the present invention, preferably, a compound represented by the above formula (V) has any one or more structures of the above formulas (IX)-1 to (IX)-7.

To the total amount of the components constituting the photosensitive layer, the added amount of the additive is preferably 0.1 to 20% by weight, more preferably 1.5 to 15.0% by weight. When the added amount of the additive exceeds 15.0% by weight, in some cases, pressure bonding of a transfer roller of a photosensitive layer facilitates crystallization, resulting in poor resistance to member pressing.

<Binder Resin>

Examples of the binder resin include thermoplastic resin such as styrene polymer, styrene-butadiene copolymer, styrene-acrylonitrile copolymer, styrene-maleic acid copolymer, acrylic polymer, styrene-acrylic copolymer, polyethylene, ethylene-vinyl acetate copolymer, chlorinated polyethylene, polyvinyl chloride, polypropylene, polyvinyl chloride acetate copolymer, polyester, polyamide, polycarbonate, polyalylate, polysulfone, diallyl phthalate resin, ketone resin, polyvinyl butyral resin and polyether resin, crosslinking thermosetting resin such as silicon resin, epoxy resin, phenol resin, urea resin, melamine resin, unsaturated polyester, alkyd resin and polyurethane, and photopolymerizing resin such as epoxy-acrylate and urethane-acrylate. These can be used alone or with a combination of two or more kinds.

<Electroconductive Substrate>

As an electroconductive substrate, various materials having conductivity can be used, and the examples include metal elements such as iron, aluminum, copper, tin, platinum, silver, vanadium, molybdenum, chromium, cadmium, titanium, nickel, palladium, indium, stainless steel and brass, plastic materials wherein the above metal is deposited or laminated, and glass coated with aluminum iodide, tin oxide, indium oxide or the like. The electroconductive substrate is used in a drum-like or sheet-like shape in accordance with the structure of an image forming apparatus to be employed. It is preferable that the electroconductive substrate has enough mechanical strength.

<Single-Layer Electrophotographic Photoreceptor>

It is preferable in terms of effectively preventing the adhesion of paper dust that the electrophotographic photoreceptor of the present invention is a single-layer electrophotographic photoreceptor which contains the above charge generating agent and hole transport agent in the same layer. For a single-layer electrophotographic photoreceptor, a charge generating agent, an electron transfer agent, a binder resin and when necessary, a hole transport agent and other additive are mixed together with a proper solvent by a roll mill, a ball mill, an attriter, a paint shaker or an ultrasonic dispersing device to prepare dispersion liquid. The dispersion liquid is applied and dried on the electroconductive substrate through a well-known method. After drying, the photosensitive layer has a thickness of 5 to 100 μm, preferably, 10 to 50 μm.

Examples of the solvent to prepare dispersion liquid include alcohols such as methanol, ethanol, isopropanol and butanol, aliphatic hydrocarbons such as n-hexane, octane and cyclohexane, aromatic hydrocarbons such as benzene, toluene and xylene, halogenated hydrocarbons such as dichloromethane, dichloroethane, carbon tetrachloride and chlorobenzene, ethers such as dimethyl ether, diethyl ether, tetrahydrofuran, dioxane, dioxolan, ethylene glycol dimethyl ether and diethylene glycol dimethyl ether, ketones such as acetone, methyl ethyl ketone and cyclohexanone, esters such as ethyl acetate and methyl acetate, dimethyl formaldehyde, dimethyl formamide and dimethyl sulfoxide. These solvents can be used alone or with a combination of two or more kinds. Moreover, in order to improve the dispersibility of a charge generating agent and a charge transport agent and the smoothness of the photoreceptor surface, a surfactant and a leveling agent can be used.

The single-layer electrophotographic photoreceptor preferably contains 0.1 to 50 parts by weight, especially, 0.5 to 30 parts by weight of charge generating agent, and 5 to 500 parts by weight, especially, 25 to 200 parts by weight of hole transport agent respectively to 100 parts by weight of binder resin. In case of using an electron transfer agent, 5 to 100 parts by weight, especially, 10 to 80 parts by weight of electron transfer agent is preferably contained to 100 parts by weight of binder resin.

The electrophotographic photoreceptor having a single-layer photosensitive layer as a photosensitive layer not only has simple structure and can be easily manufactured, but also prevents a coated layer from being defective and can improve optical characteristics. By using an electron transfer agent and a hole transport agent together as charge transport agent, in the photoreceptor having a single-layer photosensitive layer, one photoreceptor can be used both as positively charged and negatively charged types, which enables the application range of the photoreceptor to broaden.

<Multilayer Electrophotographic Photoreceptor>

To obtain a multilayer photoreceptor, a charge generating agent and a charge transport agent are respectively mixed with a proper binder resin and solvent by a roll mill, a ball mill, an attriter, a paint shaker or an ultrasonic dispersing device to prepare dispersion liquid. The dispersion liquid is applied and dried on the electroconductive substrate through a well-known method. After drying, a charge generating layer has a thickness of 0.01 to 5 μm, preferably, 0.1 to 3 μm, and a charge transport layer has a thickness of 2 to 100 μm, preferably, 5 to 50 μm.

In a multilayer photoreceptor, the charge generating layer preferably contains 5 to 1000 parts by weight, especially, 30 to 500 parts by weight of charge generating agent to 100 parts by weight of binder resin. The charge transport layer preferably contains 10 to 100 parts by weight, especially, 30 to 80 parts by weight of hole transport agent to 100 parts by weight of binder resin. When using a hole transport agent and an electron transfer agent together, 10 to 500 parts by weight, especially, 30 to 200 parts by weight of the sum of the hole transport agent and the electron transfer agent is preferably contained to 100 parts by weight of binder resin.

The photosensitive layer can contain other various additives than the aforementioned components, unless they affect image forming. Examples of such additives include deterioration inhibitors such as an antioxidant, a radical scavenger, a singlet quencher and an ultraviolet absorber, softeners, plasticizers, surface modifiers, extenders, thickeners, dispersion stabilizers, wax, acceptors and donors. In order to improve sensitivity, well-known sensitizers such as terphenyl, halonaphthoquinones and acenaphthylene can be used together with a charge generating agent.

A middle layer or a barrier layer can be formed between a single-layer photosensitive layer or a multilayer photosensitive layer and an electroconductive substrate, or between a charge generating layer and a charge transport layer that constitute a multilayer photosensitive layer, unless they disturb photoreceptor's characteristics. It is possible to form a protective layer on the surface of a photosensitive layer.

<Image Forming Apparatus>

Next, the image forming apparatus of the present invention employing the above electrophotographic photoreceptor and simultaneous development and cleaning system will be described. FIG. 1 shows a schematic illustration of the image forming apparatus. The image forming apparatus 10 of the present invention comprises a charging device 2, an exposing device 3, a developing device 4 and a transfer device 5, each of which is disposed in this order around a rotatable photoreceptor (photoreceptor drum 1). On the photoreceptor drum 1, a photosensitive layer containing the above hole transport agent is formed. In addition, it is possible to provide a paper dust removing brush 6 as a simple cleaning device which does not prevent an image forming apparatus from having smaller size.

The charging device 2 is disposed on the opposite side of the photoreceptor drum 1, keeping a predetermined distance so as not to touch each other. The charging device 2 can generate corona discharge from charging wire such as tungsten and uniformly charge the surface of the photoreceptor drum 1 so as to attain a predetermined electric potential. Preferably, on the surface of the photoreceptor drum 1, the initial charged electric potential is set to approximately 800 to 900V, for example.

The exposing device 3 is disposed on the downstream side from the charging device 2 in the rotation direction of the photoreceptor drum 1. The exposing device 3 can form an electrostatic latent image on the electrically charged surface of the photoreceptor drum 1, based on given image data, for example, using fast scanning of laser beam or analog exposure. Such exposure makes the difference in electric potential between an unexposed section and an exposed section. In other words, the initial charged electric potential is maintained in the unexposed section of the photoreceptor drum 1 while the electric potential declines to approximately 100 to 300V in the exposed section.

The developing device 4 is disposed further downstream than the exposing device 3. The developing device 4 supplies toner that is positively charged in the interior of the developing device 4 to an electrostatic latent image that is formed on an electrically charged electrophotographic photoreceptor (that is, the exposed section which is part of the uniformly charged surface and whose electric potential is lowered by exposure through the exposing device 3). Through this supply, the developing device 4 selectively carries toner on the surface of the photoreceptor drum 1 to make an image visible. As the developing device 4, for example, two-component magnetic brush developing method can be employed.

The image forming apparatus of the present invention employs so-called simultaneous development and cleaning system (cleaner-less method), according to which residual toner on the surface of the photoreceptor drum 1 is collected by the developing device 4 in the next development. Specifically, a developing bias which is direct-current voltage is applied between the developing device 4 and the photoreceptor drum 1, for example, by developing bias applying power source. The developing bias voltage is normally set to the midpoint potential of the electric potential of the exposed section and that of the unexposed section in the photoreceptor drum 1. The difference between the developing bias potential and the surface potential of the photoreceptor drum 1 turns into energy to transfer toner, thereby transferring toner from the developing device 4 to the section (latent image section) on the surface of the photoreceptor drum 1 where the electric potential declines. At this time, untransferred toner remains on and adheres thinly to the surface of the photoreceptor drum 1. Some of the untransferred toner is in the unexposed section and transferred from the surface of the photoreceptor drum 1 to the developing device 4 to be collected. Meanwhile, the other untransferred toner in the exposed section is not transferred from the surface of the photoreceptor drum 1 to the developing device 4, but conversely the toner is transferred from the developing device 4 to the exposed section of the photoreceptor drum 1, forming toner image on the surface of the photoreceptor drum 1.

For instance, when the surface potential of the photoreceptor drum 1 is +200V in the exposed section and +800V in the unexposed section and the developing bias potential to be applied to the developing device 4 is +400V, positively charged toner is subject to repulsive forces from the developing device 4 to the photoreceptor drum 1 in the exposed section due to the difference of +200V in electric potential and from the photoreceptor drum 1 to the developing device 4 in the unexposed section due to the difference of +400V in electric potential. These repulsive forces resulting from the difference in electric potential transfer toner and collect residual toner as well as develop a latent image.

The transfer device 5 is disposed further downstream than the developing device 4. As for transfer, while an image transferring member (e.g. paper) passes between the photoreceptor drum 1 and the transfer device 5, a visible image carried on the photoreceptor drum 1 is transferred to the image transferring member, and through this transfer, the charged electric potential of the unexposed section on the surface of the photoreceptor drum 1 after transfer drops to, for example, about 500 to 600V.

In case of using paper as an image transferring member, if an electrophotographic photoreceptor touches the paper, paper dust adheres to the surface of the photoreceptor drum 1. It is possible to physically remove the adhering paper dust, for example, with the paper dust removing brush 6 which is disposed further downstream and whose pointed tip touches the surface of the photoreceptor drum 1. It is also possible to provide a bias voltage applying device (not shown in drawings) for the paper dust removing brush 6 to apply bias voltage from direct-current power source. The bias voltage by the bias voltage applying device can electrically pick up paper dust.

Then, the toner image transferred to the image transferring member is subject to heat and pressure through a fixing device which is not shown in drawings, and undergoes fusing on the surface of the image transferring member.

In the image forming apparatus of the present invention, the paper dust removing brush 6 is usually disposed between the transfer device 5 and the charging device 2, if it is provided. The paper dust removing brush 6 not only removes paper dust but also can work so as to disperse residual untransferred toner on the surface of the photoreceptor drum 1 and to weaken electrostatic bond with the surface charge of the photoreceptor drum 1. Even if the apparatus employs the system of collecting toner simultaneously during development without cleaning process by elastic blade, it is possible to more efficiently collect toner during development.

The above photoreceptor drum 1 that is the electrophotographic photoreceptor of the present invention employs the aforementioned hole transport agent. Therefore, the above image forming apparatus (image forming apparatus employing simultaneous development and cleaning system) can prevent paper dust from adhering and such image defect as black lines and black spots from occurring.

Even if an image forming apparatus uses a photoreceptor drum having a diameter of not more than 25 mm and a circumferential velocity of not less than 100 mm/second to which paper dust easily adheres, the use of the above photoreceptor drum 1 that is the electrophotographic photoreceptor of the present invention makes it possible to prevent image defect caused by paper dust.

<Color Image Forming Apparatus>

The electrophotographic photoreceptor of the present invention can be applied to color image forming apparatuses.

With various color toners, for example, black toner, cyan toner, magenta toner and yellow toner, toner image can be formed on the surface of the electrophotographic photoreceptor of the present invention. By transferring the toner image to a given transfer paper in turn, a full-color image can be formed on the transfer paper. Furthermore, the transfer paper is put into a fixing device which is disposed on the paper ejection side of a transfer belt, and the transferred image is fixed on the transfer paper, thereby forming an image. It is possible to apply the electrophotographic photoreceptor of the present invention to a so-called tandem engine full-color image forming apparatus wherein special electrophotographic photoreceptors for each color toner are used and these are aligned on a transfer belt. The tandem engine full-color image forming apparatus can form an image, continuously feeding a transfer paper with a transfer belt.

The electrophotographic photoreceptor of the present invention will be described in more detail below with reference to examples and comparative examples. It is understood, however, that the examples are for the purpose of illustration and the present invention is not to be regarded as limited to any of the specific materials or condition therein.

EXAMPLES

<Measurement of Hole Mobility>

As hole transport agent, 20 types of hole transport agents (HTM-1 to HTM-20) were prepared to measure their hole mobility. The hole mobility was measured through conventional TOF (Time Of Flight) method under the environment at 25° C. The electric field intensity was set to $3\times10^5$ (V/cm). Measurement samples were prepared as follows: an applying solution was prepared so that 30% by weight of charge transport agent was contained to the total weight of a binder resin (Panlite TS2020 by Teijin Chemicals Ltd.) and a charge transport agent; the applying solution was applied on aluminum base material; and subsequently, heat treatment was carried out at 80° C. for 30 minutes. The samples had a film thickness of 7 μm. HTM-1 to HTM-7 were the same as above while HTM-8 to HTM-20 were shown as below.

HTM-8

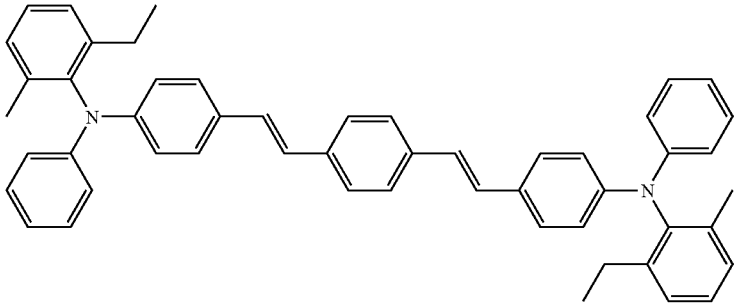

HTM-9

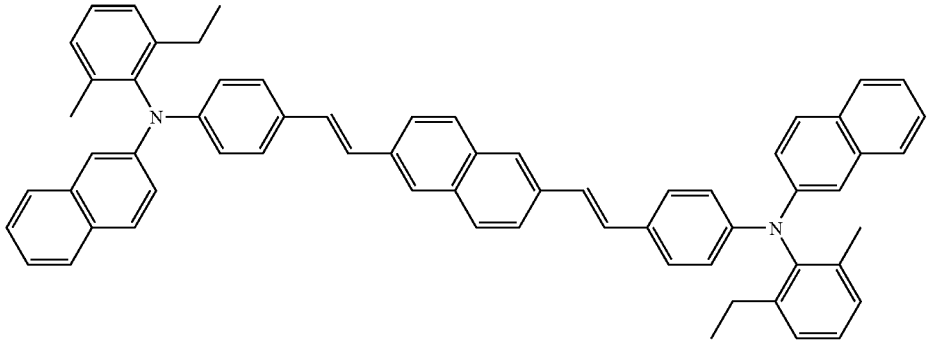

HTM-10

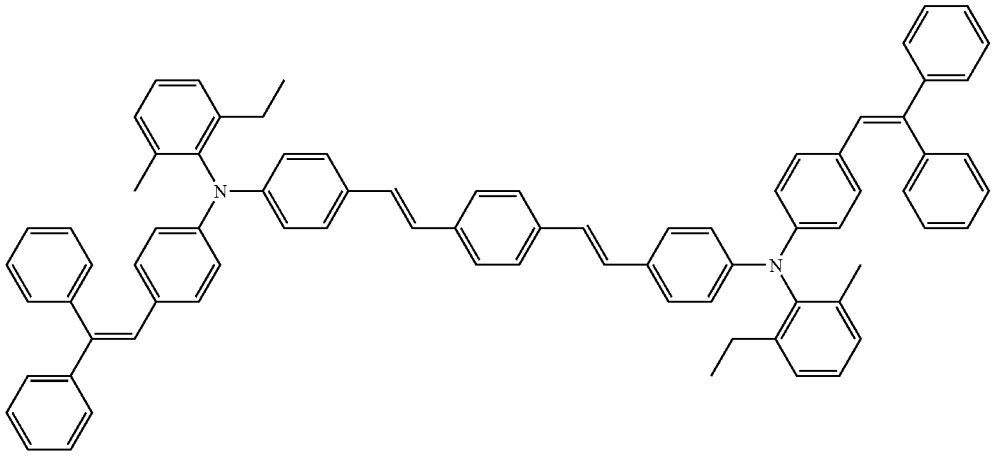

-continued
HTM-11
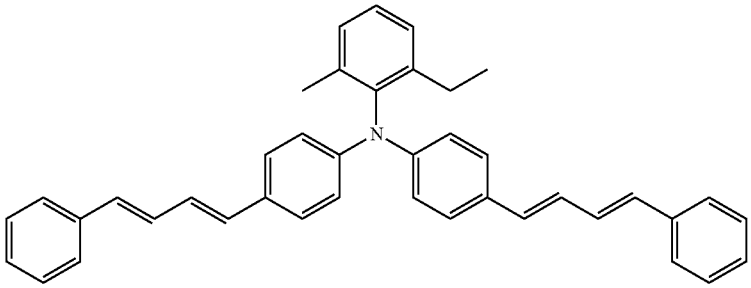
HTM-12
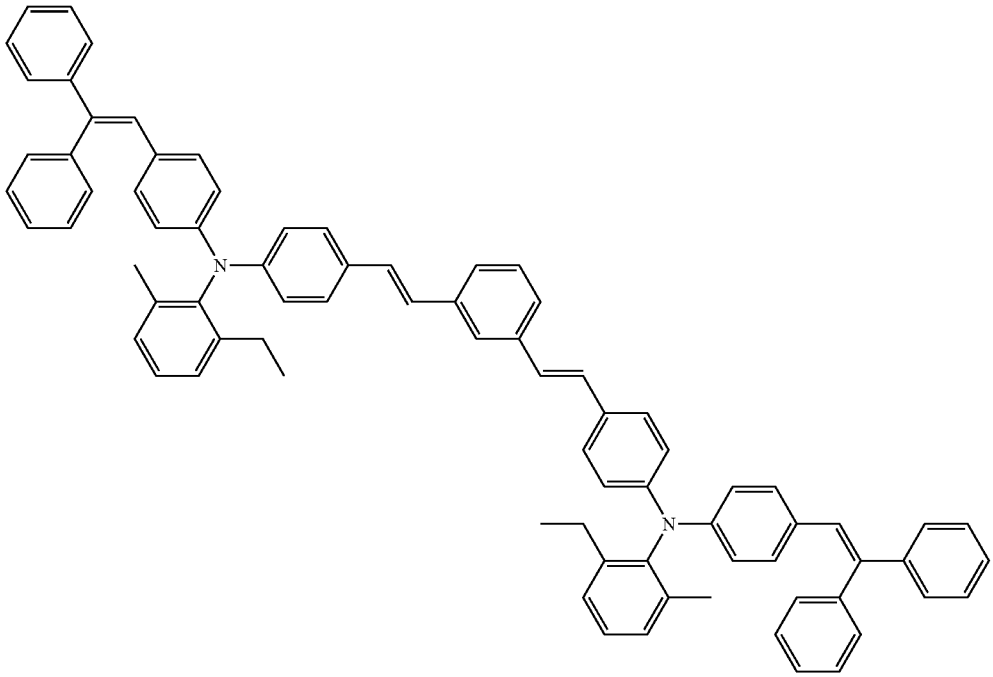
HTM-13
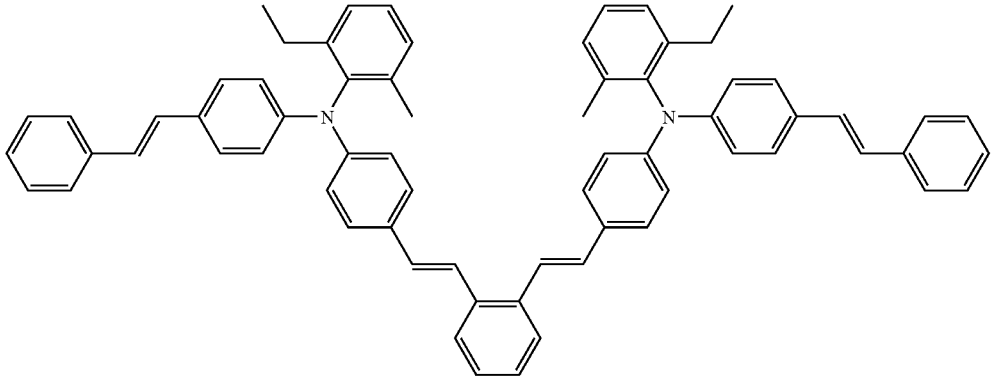

-continued
HTM-14
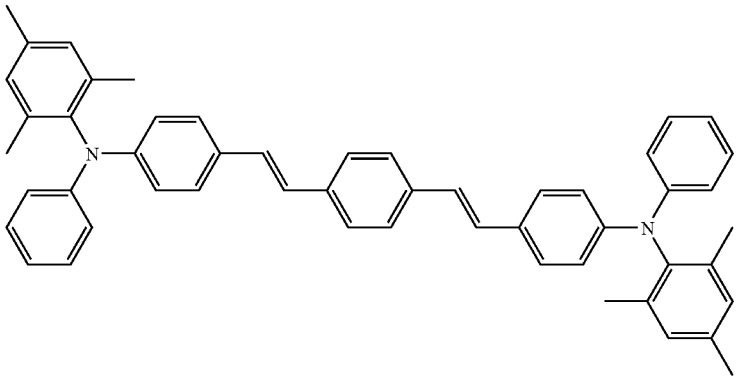
HTM-15
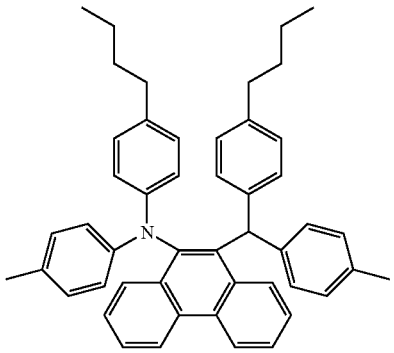
HTM-16
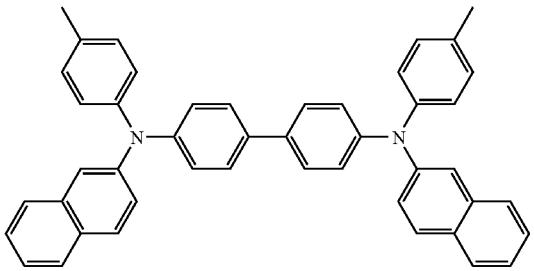
HTM-17
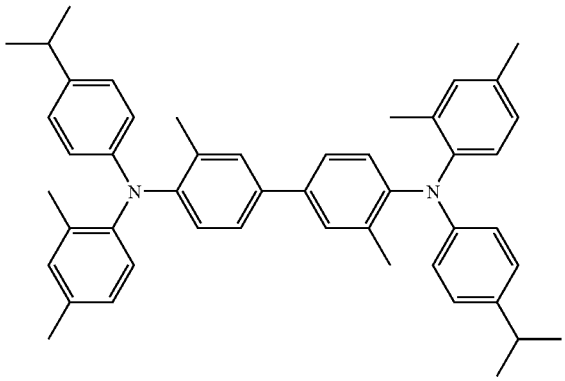
HTM-18
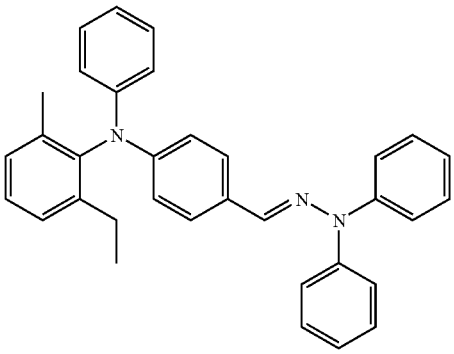
HTM-19
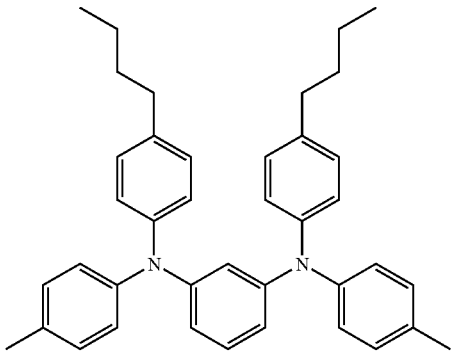

-continued

HTM-20

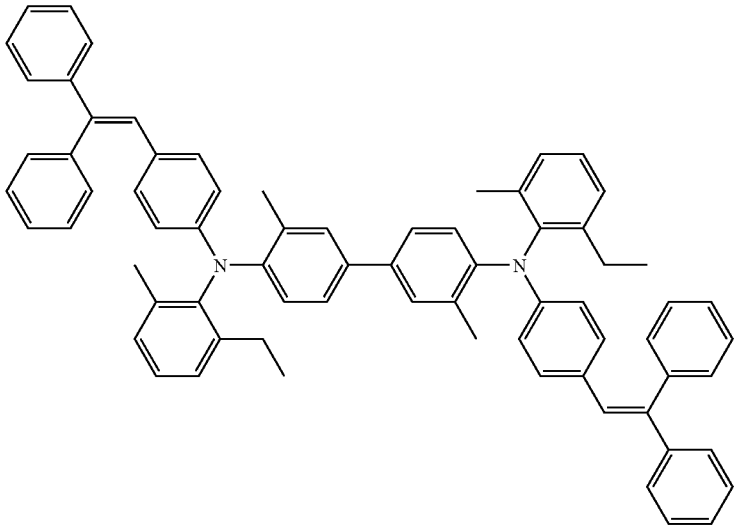

Examples 1 to 7 and Comparative Examples 1 to 13

<Preparation of Single-Layer Electrophotographic Photoreceptor>

4 parts by weight of charge generating agent (X-type metal-free phthalocyanine), 50 parts by weight of hole transport agent, 30 parts by weight of electron transfer agent and 100 parts by weight of binder resin, together with 800 parts by weight of solvent (tetrahydrofuran), were mixed and dispersed with a ball mill for 50 hours to prepare a photoreceptor applying solution. As binder resin, polycarbonate having an average molecular weight of 30000 was used. The hole transport agents used in Examples 1 to 7 and Comparative Examples 1 to 13 were shown in Table 1. Next, the above photoreceptor applying solution was applied on a conductive substrate (aluminum cylinder) through dip-coating method, and then hot-air drying was performed at 100° C. for 40 minutes, thereby obtaining a single-layer electrophotographic photoreceptor which has a film thickness of 25 μm. The charge generating agent, electron transfer agent and binder resin used here are represented by the following chemical formulas.

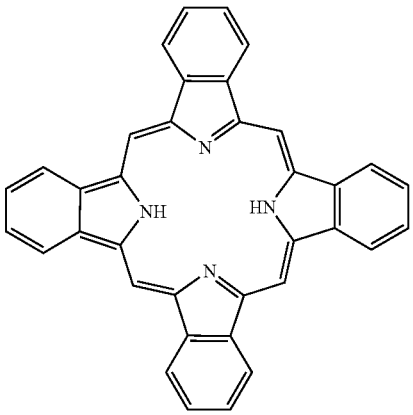

Charge generating agent

-continued

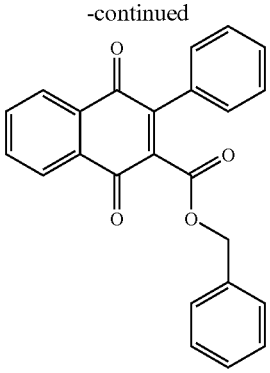

Electron transfer agent

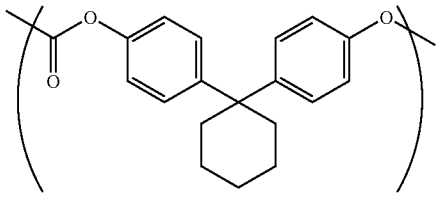

Binder resin

<Black Spot Evaluation Test>

The single-layer electrophotographic photoreceptor so prepared was installed in a printer (DP-560) by Kyocera Mita Corporation wherein electricity removal process was taken away, and 5000 sheets of paper were printed under the condition of high temperature and high humidity (room temperature 40° C. and relative humidity 90%). Then, after leaving the printer under the condition of high temperature and high humidity for 6 hours, A4-size blank paper was printed and black spots occurring in one sheet of paper were counted. This test was conducted under severe conditions in the environment out of the product coverage, and if black spots observed in this evaluation are 100 or less, images can be guaranteed.

Figure 2:
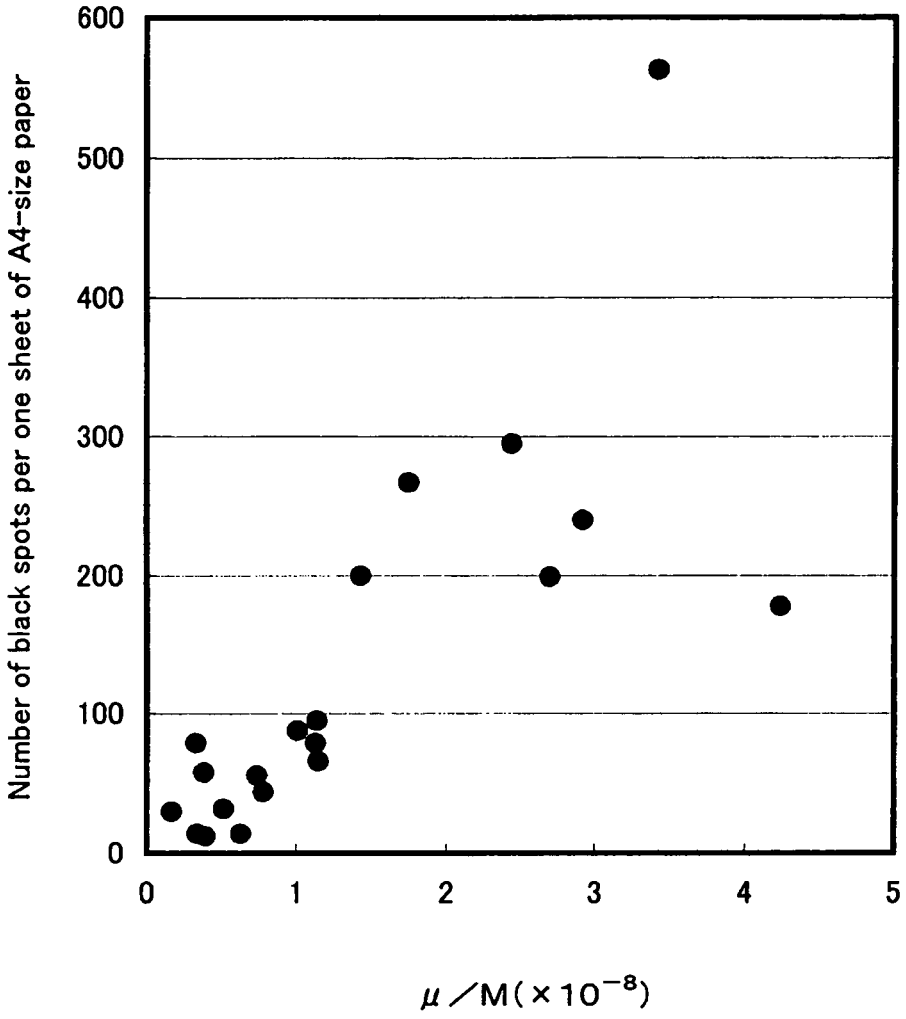
FIG. 2 is a graph showing the results of black spot evaluation test in Examples.

The results of the above black spot evaluation test were shown in FIG. 2 and Table 1. FIG. 2 is a graph showing the relation between μ/M in the employed hole transport agent (μ:

hole mobility of hole transport agent ($cm^2 \cdot V^{-1}$ seconds), M: molecular weight of hole transport agent) and the number of black spots occurring per one sheet of A4-size paper. The molecular weight of hole transport agent was figured out with software (Chem Draw Std. 8.0 by CambridgeSoft) and rounded off to two decimal places.

TABLE 1

| | Hole transport agent | M[1)] | μ[2)] | μ/M | Number of black spots |
|---|---|---|---|---|---|
| Example 1 | HTM-1 | 593.80 | $6.00 \times 10^{-6}$ | $1.010 \times 10^{-8}$ | 88 |
| Example 2 | HTM-2 | 777.05 | $5.74 \times 10^{-6}$ | $0.739 \times 10^{-8}$ | 56 |
| Example 3 | HTM-3 | 843.15 | $9.51 \times 10^{-6}$ | $1.130 \times 10^{-8}$ | 79 |
| Example 4 | HTM-4 | 871.20 | $6.80 \times 10^{-6}$ | $0.781 \times 10^{-8}$ | 44 |
| Example 5 | HTM-5 | 1057.41 | $12.10 \times 10^{-6}$ | $1.140 \times 10^{-8}$ | 95 |
| Example 6 | HTM-6 | 981.31 | $5.06 \times 10^{-6}$ | $0.516 \times 10^{-8}$ | 32 |
| Example 7 | HTM-7 | 1133.51 | $13.00 \times 10^{-6}$ | $1.150 \times 10^{-8}$ | 66 |
| Comparative Example 1 | HTM-8 | 700.95 | $12.30 \times 10^{-6}$ | $1.750 \times 10^{-8}$ | 267 |
| Comparative Example 2 | HTM-9 | 851.13 | $23.00 \times 10^{-6}$ | $2.700 \times 10^{-8}$ | 199 |
| Comparative Example 3 | HTM-10 | 1057.41 | $36.10 \times 10^{-6}$ | $3.414 \times 10^{-8}$ | 563 |
| Comparative Example 4 | HTM-11 | 543.74 | $23.10 \times 10^{-6}$ | $4.248 \times 10^{-8}$ | 178 |
| Comparative Example 5 | HTM-12 | 1057.41 | $30.90 \times 10^{-6}$ | $2.920 \times 10^{-8}$ | 240 |
| Comparative Example 6 | HTM-13 | 905.22 | $22.10 \times 10^{-6}$ | $2.440 \times 10^{-8}$ | 295 |
| Comparative Example 7 | HTM-14 | 700.95 | $10.00 \times 10^{-6}$ | $1.430 \times 10^{-8}$ | 200 |
| Comparative Example 8 | HTM-15 | 652.91 | $4.10 \times 10^{-6}$ | $0.628 \times 10^{-8}$ | 14 |
| Comparative Example 9 | HTM-16 | 616.79 | $2.10 \times 10^{-6}$ | $0.340 \times 10^{-8}$ | 14 |
| Comparative Example 10 | HTM-17 | 656.94 | $1.10 \times 10^{-6}$ | $0.167 \times 10^{-8}$ | 30 |
| Comparative Example 11 | HTM-18 | 481.63 | $1.85 \times 10^{-6}$ | $0.384 \times 10^{-8}$ | 58 |
| Comparative Example 12 | HTM-19 | 552.79 | $2.19 \times 10^{-6}$ | $0.396 \times 10^{-8}$ | 12 |
| Comparative Example 13 | HTM-20 | 957.29 | $3.16 \times 10^{-6}$ | $0.330 \times 10^{-8}$ | 79 |

[1)]M: Molecular weight of hole transport agent
[2)]μ: Hole mobility of hole transport agent ($cm^2 \cdot V^{-1} \cdot second^{-1}$)

<Initial Sensitivity Evaluation Test>

The photoreceptors obtained in Examples 1 to 7 and Comparative Examples 1 to 13 were installed in a printer (DP-560) by Kyocera Mita Corporation wherein electricity removal process was taken away. The charged electric potential was set to +800V, and their sensitivity in a developing position was measured under the environment at 20° C. The results were shown in Table 2.

TABLE 2

| | Initial sensitivity (V) |
|---|---|
| Example 1 | 108 |
| Example 2 | 95 |
| Example 3 | 75 |
| Example 4 | 88 |
| Example 5 | 82 |
| Example 6 | 130 |
| Example 7 | 79 |
| Comparative Example 1 | 79 |
| Comparative Example 2 | 76 |

TABLE 2-continued

| | Initial sensitivity (V) |
|---|---|
| Comparative Example 3 | 69 |
| Comparative Example 4 | 73 |
| Comparative Example 5 | 67 |
| Comparative Example 6 | 93 |
| Comparative Example 7 | 96 |
| Comparative Example 8 | 140 |
| Comparative Example 9 | 158 |
| Comparative Example 10 | 197 |
| Comparative Example 11 | 187 |
| Comparative Example 12 | 170 |
| Comparative Example 13 | 136 |

According to FIG. 2 and Table 1, when μ/M was less than $1.2 \times 10^{-8}$, the number of black spots occurring was less than 100. On the other hand, when μ/M was more than $1.2 \times 10^{-8}$ (Comparative Examples 1 to 7), the number of black spots sharply increased. In Comparative Examples 8 to 13, since μ/M was less than $1.2 \times 10^{-8}$, the number of black spots occurring was less than 100, but the hole mobility was not more than $5.0 \times 10^{-6}$ and, as shown in Table 2, sensitivity was poor, making it difficult to meet the demand of higher speed image forming apparatuses. Therefore, preferable are the hole transport agents of Examples 1 to 7 whose μ/M was less than $1.2 \times 10^{-8}$ and whose hole mobility was more than $5.0 \times 10^{-6}$. After finishing the above test, the surface of the photoreceptor was visually checked. In Examples 1 to 7 and Comparative Examples 8 to 13, wherein μ/M was less than $1.2 \times 10^{-8}$, a smaller amount of paper dust adhered than in Comparative Examples 1 to 7, wherein μ/M was not less than $1.2 \times 10^{-8}$.

Examples 8 to 33

<Preparation of Single-Layer Electrophotographic Photoreceptor>

Except that 0 to 30 parts by weight of any one of the following additives A to E was added, the photoreceptors here were prepared in the same manner as the single-layer electrophotographic photoreceptors in Examples 1 to 7 and Comparative Examples 1 to 13. The following are the chemical formulas of the additives used here.

(Additive-A)

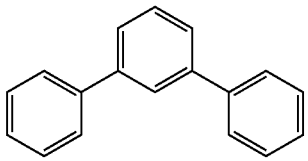

-continued (Additive-B)

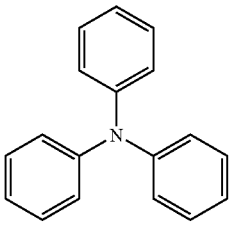

(Additive-C)

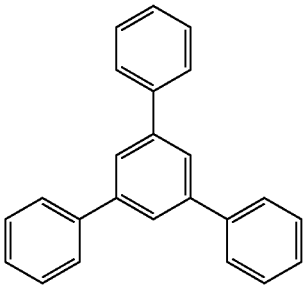

(Additive-D)

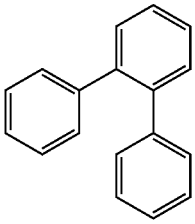

(Additive-E)

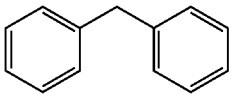

<Crack Resistance Evaluation Test, Member Pressing Test and Their Evaluation Method>

(Crack Resistance Evaluation Test)

Having sebum adhere directly to the surface of the photosensitive layer, the photoreceptor was kept in the normal environment (room temperature 20° C., relative humidity 60%) for five days. Then, observing the surface of the photoreceptor with a microscope, whether cracks occurred at a point of sebum adhering was checked.

The growth rate of cracks was figured out, based on the elapsed time and the measurement results of crack length.

Regarding the evaluation on crack resistance, after the above evaluation test, a crack having a length of less than 2.00 mm was rated as ◎, a crack having a length of not less than 2.00 to less than 4.00 mm was rated as ○, a crack having a length of not less than 4.00 to less than 5.00 mm was rated as Δ, and a crack having a length of not less than 5.00 mm was rated as ×.

(Member Pressing Test)

Pressing a transfer roller to the photoreceptor surface, the photoreceptor was kept under the condition of high temperature and high humidity (room temperature 50° C. and relative humidity 90%) for five days. Then, observing the surface of the photoreceptor with a microscope, whether crystals and cracks occurred was checked.

Regarding the evaluation on member pressing, a photoreceptor wherein no imprint of the pressed transfer roller was visually observed was rated as ○, while a photoreceptor wherein a slight imprint of the pressed transfer roller was visually observed was rated as Δ.

The results of the above evaluation tests were shown in Table 3.

TABLE 3

| | Hole transport agent | M[1)] | μ[2)] | μ/M | Type of additive | Additive/w % | Crack growth rate/mm · min$^{-1}$ | Crack resistance | Member pressing test |
|---|---|---|---|---|---|---|---|---|---|
| Example 8 | HTM-2 | 777.05 | $5.74 \times 10^{-6}$ | $0.739 \times 10^{-8}$ | A | 1.5 | 1.70 | ◎ | ○ |
| Example 9 | | | | | | 4.3 | 1.28 | ◎ | ○ |
| Example 10 | | | | | | 7.2 | 0.51 | ◎ | ○ |
| Example 11 | | | | | | 12.1 | 0.00 | ◎ | ○ |
| Example 12 | | | | | | 15.0 | 0.00 | ◎ | ○ |
| Example 13 | | | | | | 16.0 | 0.00 | ◎ | Δ |
| Example 14 | | | | | | 17.0 | 0.00 | ◎ | Δ |
| Example 15 | HTM-5 | 1057.41 | $12.10 \times 10^{-6}$ | $1.140 \times 10^{-8}$ | B | 2.0 | 1.80 | ◎ | ○ |
| Example 16 | | | | | | 8.0 | 1.20 | ◎ | ○ |
| Example 17 | | | | | | 7.4 | 1.60 | ◎ | ○ |
| Example 18 | HTM-1 | 593.80 | $6.00 \times 10^{-6}$ | $1.010 \times 10^{-8}$ | A | 4.2 | 2.00 | ○ | ○ |
| Example 19 | HTM-2 | 777.05 | $5.74 \times 10^{-6}$ | $0.739 \times 10^{-8}$ | | | 1.33 | ◎ | ○ |
| Example 20 | HTM-3 | 843.15 | $9.51 \times 10^{-6}$ | $1.130 \times 10^{-8}$ | | | 2.50 | ○ | ○ |
| Example 21 | HTM-4 | 871.20 | $6.80 \times 10^{-6}$ | $0.781 \times 10^{-8}$ | | | 1.00 | ◎ | ○ |
| Example 22 | HTM-5 | 1057.41 | $12.10 \times 10^{-6}$ | $1.140 \times 10^{-8}$ | | | 1.56 | ◎ | ○ |
| Example 23 | HTM-6 | 981.31 | $5.06 \times 10^{-6}$ | $0.516 \times 10^{-8}$ | | | 3.55 | ○ | ○ |
| Example 24 | HTM-7 | 1133.51 | $13.00 \times 10^{-6}$ | $1.150 \times 10^{-8}$ | | | 1.30 | ◎ | ○ |
| Example 25 | HTM-6 | 981.31 | $5.06 \times 10^{-6}$ | $0.516 \times 10^{-8}$ | A | 3.6 | 2.81 | ○ | ○ |
| Example 26 | | | | | B | | 2.34 | ○ | ○ |
| Example 27 | | | | | C | | 3.82 | ○ | ○ |
| Example 28 | | | | | D | | 2.63 | ○ | ○ |
| Example 29 | | | | | E | | 3.22 | ○ | ○ |
| Example 30 | HTM-3 | 843.15 | $9.51 \times 10^{-6}$ | $1.130 \times 10^{-8}$ | D | 1.4 | 4.32 | Δ | Δ |
| Example 31 | | | | | | 1.0 | 4.56 | Δ | Δ |
| Example 32 | | | | | | 0.3 | 4.98 | Δ | Δ |
| Example 33 | HTM-7 | 1133.51 | $13.00 \times 10^{-6}$ | $1.150 \times 10^{-8}$ | A | 0.9 | 4.89 | Δ | Δ |

[1)]M: Molecular weight of hole transport agent

[2)]μ: Hole mobility of hole transport agent ($cm^2 \cdot V^{-1} \cdot second^{-1}$)

According to Table 3, even if any of the additives A to E was used, when the amount of additive was 0.3 to 17.0% by weight to the total amount of the components constituting the photosensitive layer (Examples 8 to 29), good resistance to cracks was achieved. When the amount of additive was less than 1.5% by weight (Examples 30 to 33), crack resistance was slightly lowered but had no problems from a practical standpoint. As for member pressing test, when the amount of additive was 1.5 to 15.0% by weight (Examples 8 to 12 and Examples 15 to 29), good results were obtained. When the amount of additive exceeded 15.0% by weight (Examples 13 and 14) or when the amount of additive was less than 1.5% by weight (Examples 30 to 33), the results of member pressing test were slightly lowered but had no problems from a practical standpoint.

Although the present invention has been described in relation to particular embodiments thereof, many other variations and modifications and other uses will become apparent to those skilled in the art. Therefore, the present invention is to be limited not by the specific disclosure therein, but only by the appended claims.

What is claimed is:

1. An electrophotographic photoreceptor comprising an electroconductive substrate, and a photosensitive layer consisting of a single photosensitive layer on the electroconductive substrate, wherein the photosensitive layer comprises a charge generating agent, a hole transport agent, and an additive, wherein the hole transport agent is one or more compounds selected from the group consisting of HTM-3 and HTM-4, having the following formulas

HTM-3

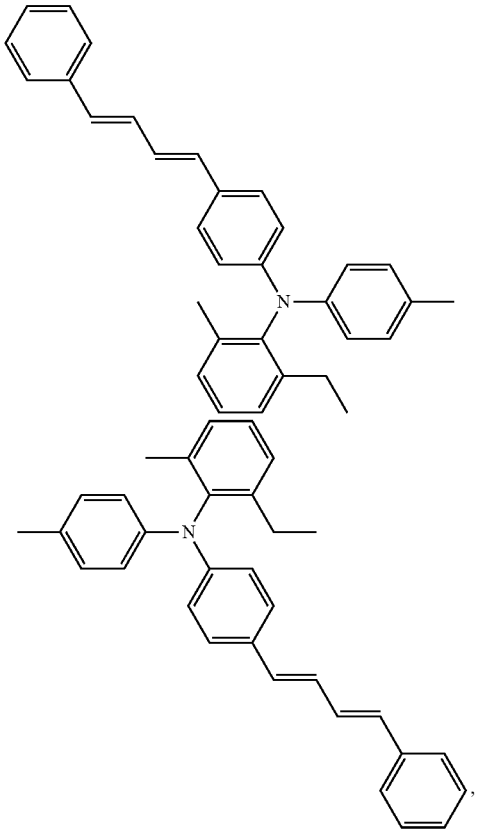

, and

-continued

HTM-4

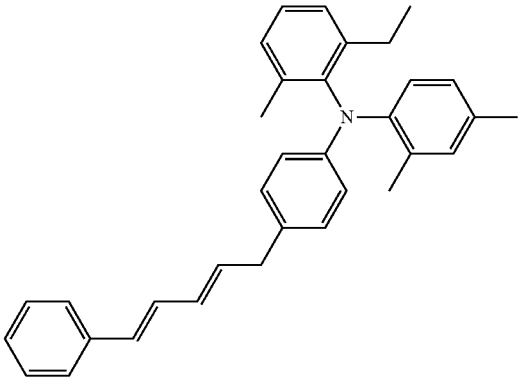

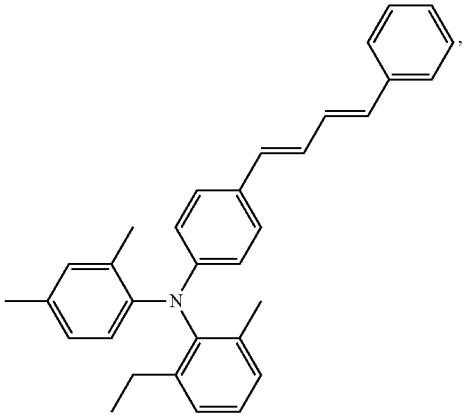

, wherein the photosensitive layer contains, as the additive, compound (VIII)-2 having the formula (VIII-2)

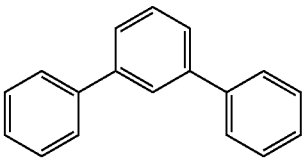

.

* * * * *